US005876555A

United States Patent [19]

Hellsund et al.

[11] Patent Number: 5,876,555

[45] Date of Patent: Mar. 2, 1999

[54] APPARATUS AND METHOD FOR APPLYING A LABEL TO A PACKAGE

[75] Inventors: Per Hellsund, East Lyme; George Rinaudo, North Stonington, both of Conn.

[73] Assignee: Gunther International, Ltd., Norwich, Conn.

[21] Appl. No.: 741,899

[22] Filed: Oct. 31, 1996

[51] Int. Cl.[6] ..... B65C 9/00

[52] U.S. Cl. ..... 156/540; 156/566; 156/570; 156/249; 156/DIG. 38

[58] Field of Search ..... 156/540, 541, 156/542, 566, DIG. 38, 570, DIG. 33, 249

[56] References Cited

U.S. PATENT DOCUMENTS 4,124,436 11/1978 Pettis, Jr. et al. ..... 156/542
4,324,608 4/1982 Klinger ..... 156/542 X
4,595,447 6/1986 Lindstrom ..... 156/542 X
4,612,079 9/1986 Ostrow ..... 156/541 X
4,773,961 9/1988 Glorioso ..... 156/542 X
5,022,654 6/1991 Plaessmann ..... 156/542

*Primary Examiner*—James Engel
*Attorney, Agent, or Firm*—Ware, Fressola, Van der Sluys & Adolphson LLP

[57] ABSTRACT

An apparatus for labelling packages with postage meter labels performs a method in which postage metered label combinations are received from a label feeder and postage meter, the label is stripped from its release sheet, and then the label is applied to its respective package. The labelling apparatus and method are designed for use in a high speed electronic finishing system.

14 Claims, 13 Drawing Sheets

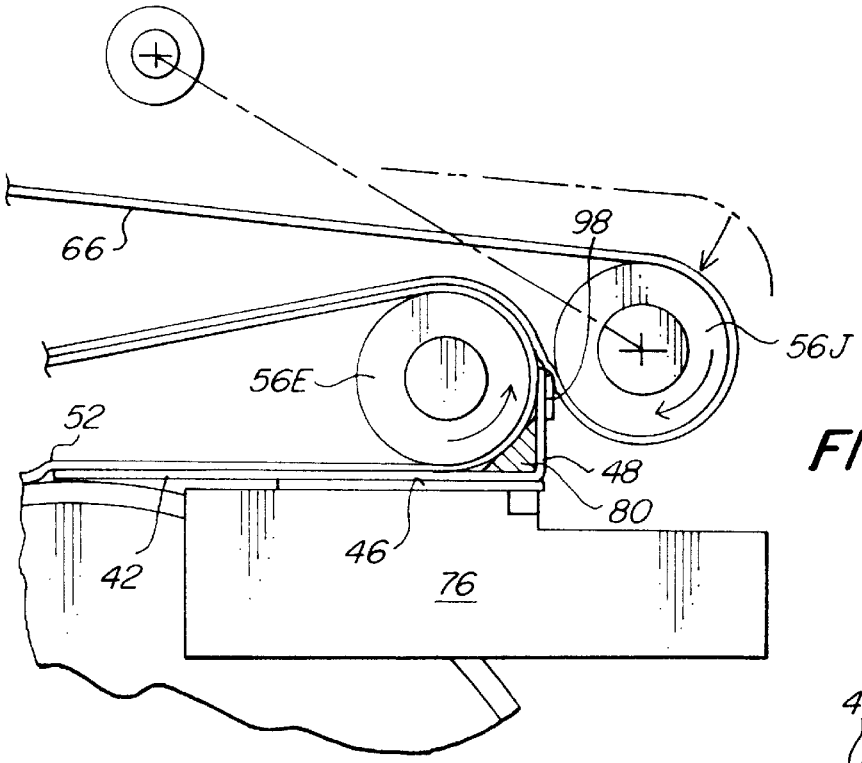
FIG. 9C
FIG. 9D
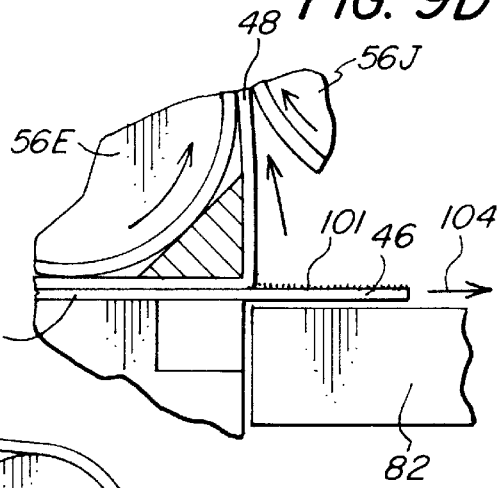
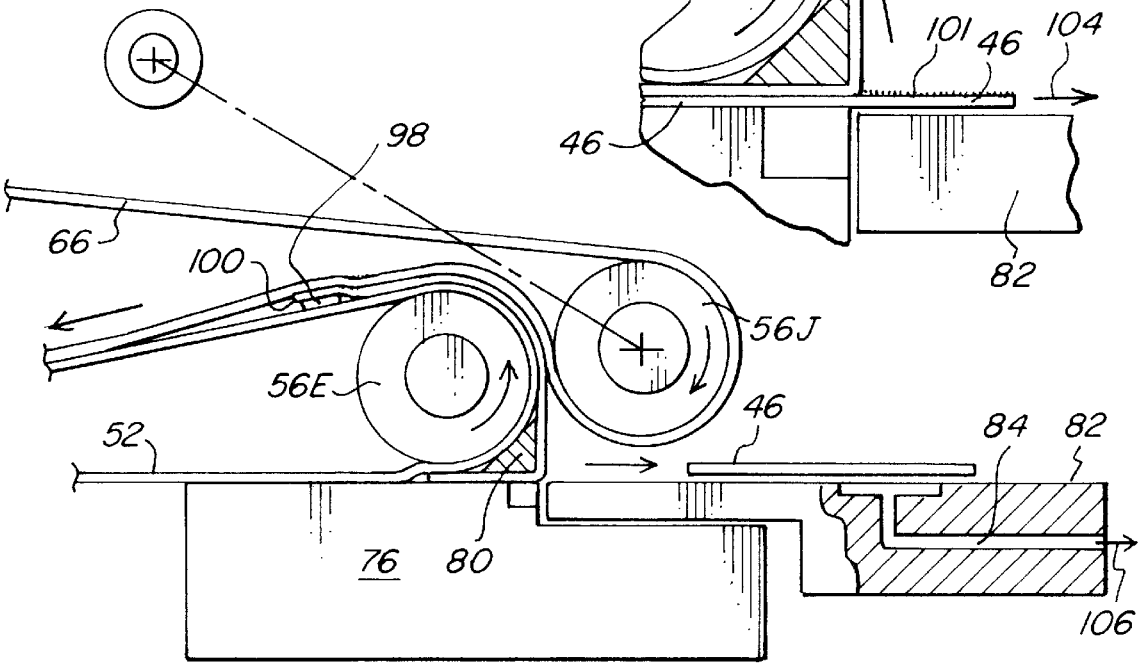
FIG. 9E

APPARATUS AND METHOD FOR APPLYING A LABEL TO A PACKAGE

BACKGROUND OF THE INVENTION

1. Field of the Invention

The present invention relates to an apparatus and method for applying a label to an package and, more particularly, to an apparatus and method for applying metered postage labels to packages being conveyed in an electronic finishing system.

2. Description of the Prior Art

In the electronic finishing field, multi-page documents such as insurance policies and contracts are printed on high-speed laser printers and then finished on an electronic finishing system which assembles the document and adds any desired inserts (such as prefolded advertising brochures or other solicitations) to the document to create a product and then inserts the product into a standard envelope to create a package ready for mailing. These steps are done at high speed while the accuracy of the document assembly is verified through use of a printed bar code on each sheet of the document.

Before mailing, the packages have to be weighed and postage has to be applied thereto. Heretofore, such postage application has been done by hand. There is one prior art electronic finishing system that provides in-line postage application directly to the package. One of the drawbacks of this postage application system is that it only applies postage to packages having a maximum thickness of about ⅜ inch.

The present invention is designed to overcome the above limitations that are attendant upon the use of "prior art" devices, and toward this end, it contemplates the provision of a novel apparatus and method for applying postage to packages travelling in an electronic finishing system.

It is an object of the present invention to provide an apparatus and method utilizing postage labels which are printed with the proper postage and applied to the packages.

It is also an object to provide such an apparatus and method utilizing a device which strips the labels from their release sheets and transports the labels to a position for application on the packages as they are travelling through the electronic finishing system.

Yet another object is to provide an apparatus and method which accomplish the postage application at high speeds.

A further object is to provide an apparatus that is compatible with conventional electronic finishing systems and is generally compatible in physical size, form and configuration with such systems, to be readily adaptable for the same use without disadvantage.

It is a general aim of the invention to provide such an apparatus which may be readily and economically fabricated and will have long life in operation and significantly greater flexibility in use.

SUMMARY OF THE INVENTION

It has now been found that the foregoing and related objects can be readily attained in a labelling apparatus and method in accordance with the present invention which facilitate the application of a metered postage label to a package.

According to the invention, a label application apparatus is provided which comprises (1) a conveying device for delivering one sequentially delivered package at a time, (2) a label separating device for separating an adhesive backed label from its release sheet for each sequentially delivered package and delivering the adhesive backed label to a shuttle device adjacent the conveying device, and (3) a shuttle device for receiving the adhesive backed label from the label separating device, transporting the adhesive backed label to a position adjacent its respective sequentially delivered package and applying the adhesive backed label to its respective sequentially delivered package on the conveying device.

In applying a label, a sequentially delivered package is provided on the conveying device and an adhesive backed label on a release sheet is provided to the label separating device which separates the adhesive backed label from the release sheet. The adhesive backed label separated from the release sheet is then delivered to the shuttle device and transported to a position adjacent the sequentially delivered package. Finally, the adhesive backed label is applied to its respective sequentially delivered package on the conveying device.

Desirably, the label separating device includes two opposed endless belts for transporting each adhesive backed label on its release sheet to a position adjacent the shuttle device. The label separating device also includes a corner member around which the release sheet passes to separate the adhesive backed label from its release sheet and to deliver the adhesive backed label to the shuttle device. The label separating device has an air blast device for causing the release sheet to begin to pass around the corner as well as to be engaged by the endless belts. In addition, one of the endless belts is reciprocally moveable to grasp the release sheet as the air blast causes the release sheet to pass around the corner.

In another feature of the invention, the shuttle device has a shuttle cooperating with the label separating device for receiving the adhesive backed label therefrom, transporting the adhesive backed label to a position adjacent its respective sequentially delivered package and applying the adhesive backed label to its respective sequentially delivered package. During its operation, the shuttle is reciprocated between a position adjacent the label separating device to a position adjacent the conveying device and then is relatively moved toward each sequentially delivered package for applying the adhesive backed label thereto.

In order to ensure transfer of each adhesive backed label to its respective package, a tamper device is provided to cooperate with the shuttle to sandwich each sequentially delivered package and thereby applying the adhesive backed label on the shuttle to its respective sequentially delivered package. The tamper device and the shuttle are relatively moveable toward each other to apply the adhesive backed label on the shuttle to its respective sequentially delivered package.

In an alternative embodiment of the shuttle, the shuttle includes a carriage which is reciprocated on a track between a position adjacent the label separating device to a position adjacent the conveying device. A turntable is used for positioning the carriage relative to the conveying device and rotating the shuttle just prior to applying the adhesive backed label to its respective sequentially delivered package whereby the adhesive backed label achieves a "landscape" orientation on the envelope.

The invention will be fully understood when reference is made to the following detailed description taken in conjunction with the accompanying drawings.

BRIEF DESCRIPTION OF THE DRAWINGS

FIGS. 9A–9E are schematic diagrammatic side elevational views of the anvil portion of the label separating system of the labelling apparatus of the present invention showing the sequence of operation for the separation of a label from its release sheet;

DETAILED DESCRIPTION OF THE INVENTION

Figure 1:
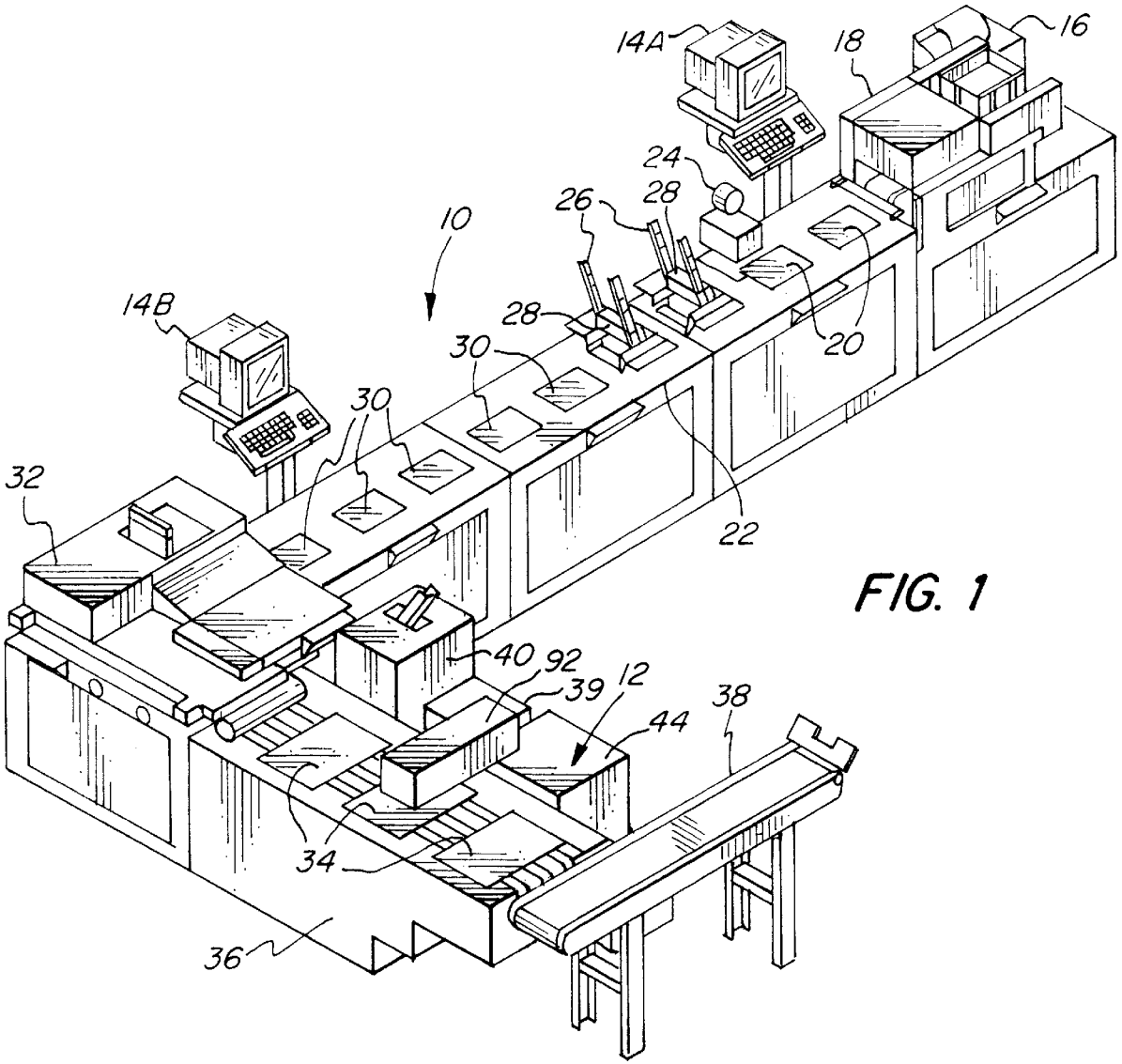
FIG. 1 is a perspective view of an electronic finishing system which utilizes the labelling apparatus of the present invention.

Turning first to FIG. 1 of the drawings, therein illustrated is an electronic finishing system generally designated by the numeral 10 which utilizes a labelling module generally indicated by numeral 12 and made in accordance with the present invention. A computer processing unit (not shown) including two keyboard/monitor units 14A, 14B allows the user to track the operation of the electronic finishing system 10. The electronic finishing system 10 has a log printer 16 which keeps track of the operation of the electronic finishing system 10 including hourly rate, errors, etc.

Sheets of paper to be fed into the electronic finishing system 10 are placed into a primary document feeder 18. The document feeder 18 separates the sheets into individual stacks 20. For example, the stacks 20 could be individual insurance policies. Each sheet in each assembled stack 20 of sheets has had a bar code printed thereon to verify the accuracy of its assembled stack 20. Bar code readers and sensors (not shown) are appropriately located throughout the electronic finishing system 10 so the computer processing unit can monitor each stack 20 of sheets as it proceeds through the electronic finishing system 10. As the stacks 20 exit from the document feeder 18, they are transferred onto a high-speed conveyor system 22 which transports the stacks 20 for stapling by a stapler 24. The user can choose whether a stack 20 is to be stapled or not through use of the computer processing unit or the computer processing unit automatically chooses stapling or not based on various factors, e.g., the number of sheets in the document. The stacks 20 are then transferred by the high-speed conveyor system 22 to a plurality of insert feeders 26 spaced above the high-speed conveyor system 22 for feeding inserts 28 onto the stacks 20 to create products 30. The computer processing unit controls the operation of the insert feeders 26 and signals them to feed the appropriate insert(s) 28 in accordance with the specific needs of stacks 20 passing underneath. Thereafter, the products 30 continue along the high-speed conveyor 22 and are inserted into envelopes at an enveloper 32 to create packages 34. Each package 34 is introduced with its front side down to an indexing conveyor 36 which transports the package 34 to the labelling module 12 for applying the proper postage on the package 34 in a manner to be explained further hereinafter. The packages 34 labelled with postage proceed onto a slowly indexed conveyor 38 where the packages 34 are aligned in a shingled manner ready to be mailed.

Turning now to FIGS. 2–5 taken in conjunction with FIG. 1, the labelling module 12 of the present invention has a postage meter 39 with a singulator feeder 40 into which a stack of label-tab-release sheet combinations 42 (see also FIGS. 6–8) are loaded. Adjacent the postage meter 39 is a label separating system 44 for separating a label 46 from its release sheet 48 in a manner and for a purpose as will be explained further hereinafter. A label shuttle device 50 adjoins the label separating system 44 for conveying a separated label 46 from the label separating system 44 to the package 34 on which it is to be applied.

The label separating system 44 has a first endless belt 52 which follows a first endless path formed by a roller drum 54 and a series of spaced rollers 56A–56I. The roller 56I is mounted on a pair of pivot arms 58 (FIGS. 4–5) which are connected through an arm 60 to a pneumatic piston-cylinder device 62. This arrangement permits the pivot arms 58 to move as indicated by arrow 64 between its solid-line and phantom-line positions in FIG. 5 upon activation of the pneumatic piston-cylinder device 62 thereby loosening the first endless belt 52 allowing the replacement of the first endless belt 52 and the clearance of jams.

Cooperating with the first endless belt 52 along an abutting portion thereof is a second endless belt 66 which follows a second endless path formed by rollers 56F, 56G and 56J–56M. The roller 56J is mounted on the end of a pivot arm 68 which is connected at its other end to an arm 70 and a pneumatic piston-cylinder device 72. This arrangement permits the 56J to move in the directions indicated by arrow 74 (FIG. 5) for a purpose to be explained further hereinafter.

Adjacent the upper portion of the roller drum 54 is a platform 76 with an air blast device 78. An anvil 80 for separating the label 46 from its release sheet 48 is located above the platform 76 and positioned adjacent the first endless path as it proceeds around the roller 56E.

Figure 3:
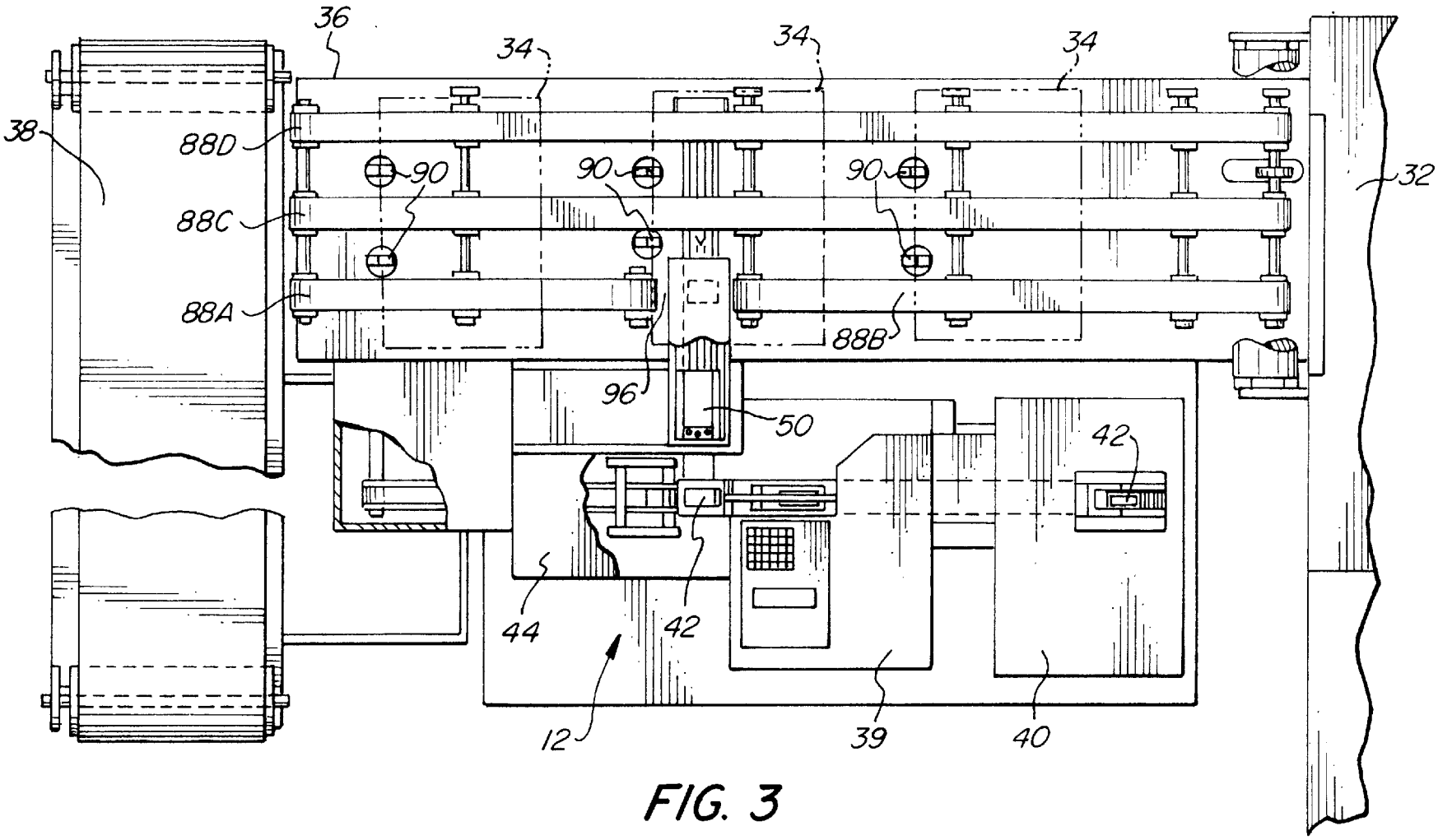
FIG. 3 is a top plan view of a portion of the electronic finishing system showing the labelling apparatus of the present invention with parts of its housing broken away to illustrate internal structure.

Extending across the platform 76 is a portion of a shuttle 82 of the label shuttle device 50 which accepts the label 46 (adhesive side up) as it is separated from its release sheet 48 and transports the label 46 for application onto the package 34. The shuttle 82 has a vacuum system 84 to hold the label 46 in place once it is separated from the label-tab-release sheet combination 42. The shuttle 82 is mounted on a magnetically coupled rodless cylinder device 86 (commercially available from SMC, 3011 N. Franklin Road, Indianapolis, Ind. as Model No. NCDY2S10H1300) for movement to a position within the indexing conveyor 36 which has four endless belts 88A–88D (as best seen in FIG. 3) upon by which the packages 34 are transported. The indexing conveyor 36 includes moveable abutment fingers 90 against which the packages 34 are indexed. The abutment fingers 90 are designed to move downwardly by means of pneumatic piston-cylinder devices (not shown) to a position below the top level of the endless belts 88A–88D to permit the packages 34 to pass to their next index station and, as soon as the indexing packages 34 pass the moveable abutment fingers 90, the fingers 90 move upwardly to receive the next upstream package 34. Above the indexing conveyor 36 is a tamper device 92 designed to cooperate with the shuttle 82 to apply the label 46 to its package 34. The tamper device 92 includes a tamper 94 made of a resilient material. The tamper 94 is positioned above a gap 96 (FIG. 3) formed between the endless belts 88A and 88B.

Figure 6:
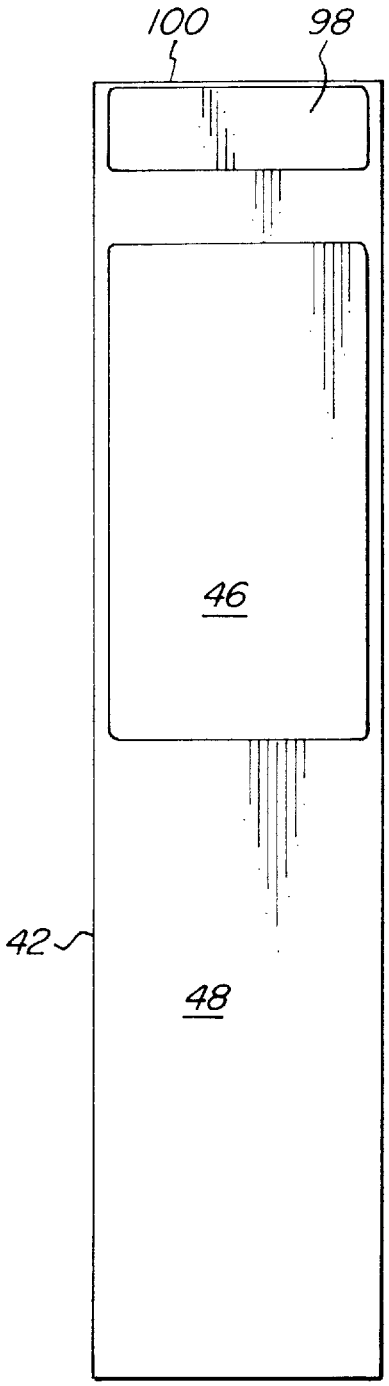
FIGS. 6–8 are top plan, side elevational and perspective views, respectively, of a label-tab-release sheet combination used in the present invention.
Figure 7:
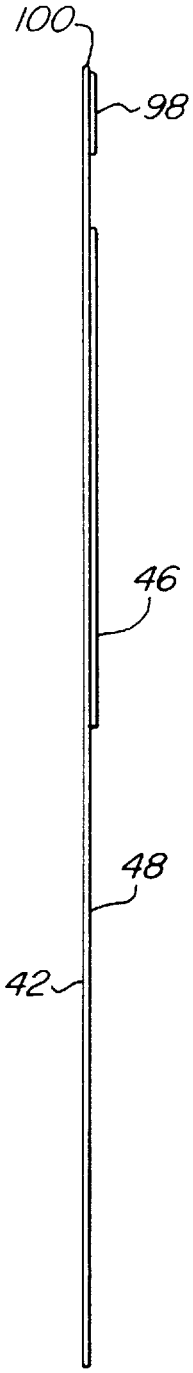
Figure 8:
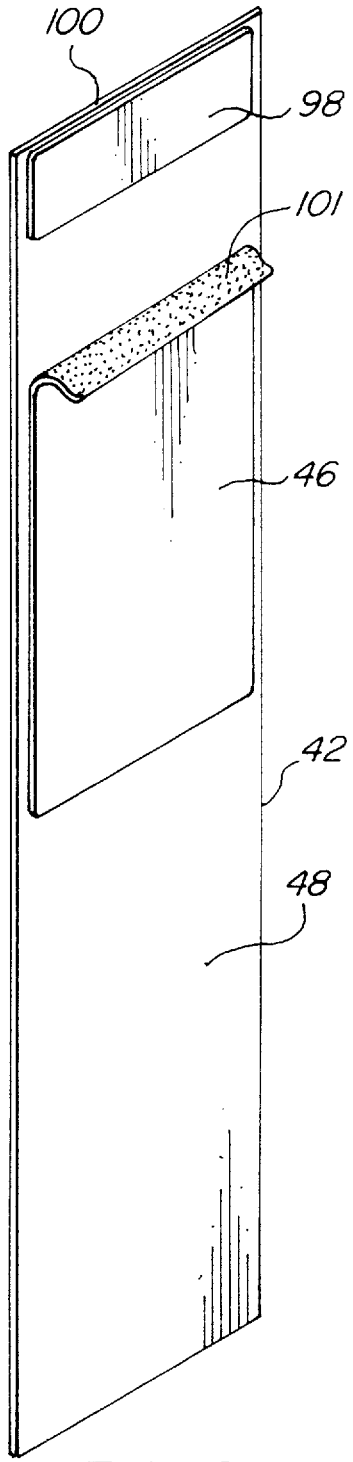

Referring to FIGS. 6–8, the label-tab-release sheet combination 42 has its adhesive label 46 (which is generally rectangular) releasably mounted on its generally rectangular release sheet 48 along with a tab 98 on its leading edge 100. The release sheet 48 has a trailing edge opposite the leading edge 100. The adhesive backed label 46 is located on the release sheet 48 spaced from the leading edge and trailing ends thereof, thereby creating a leading portion of the release sheet 48 between the leading edge and the adhesive backed label 46 and a trailing portion of the release sheet 48 between the trailing edge and the adhesive backed label 46. The release sheet 48 has the following dimensions: length—7.88 inches; width—1.73 inches; and thickness—0.003 inch to 0.004 inch. The label 46 is a nonglossy material compatible for printing with ink and has an adhesive 101 (FIG. 8) on one side compatible with twenty to thirty pound bond paper. The label dimensions are as follows: length—3.00 inches; width—1.57 inches; and thickness—0.004 inch to 0.005 inch. The label 46 is spaced 0.47 inch from the tab 98 which is made from the same material as the label 46. The tab 98 has the following dimensions: length—0.50 inch; width—1.57 inches; and thickness—0.004 inch to 0.005 inch.

Figure 2:
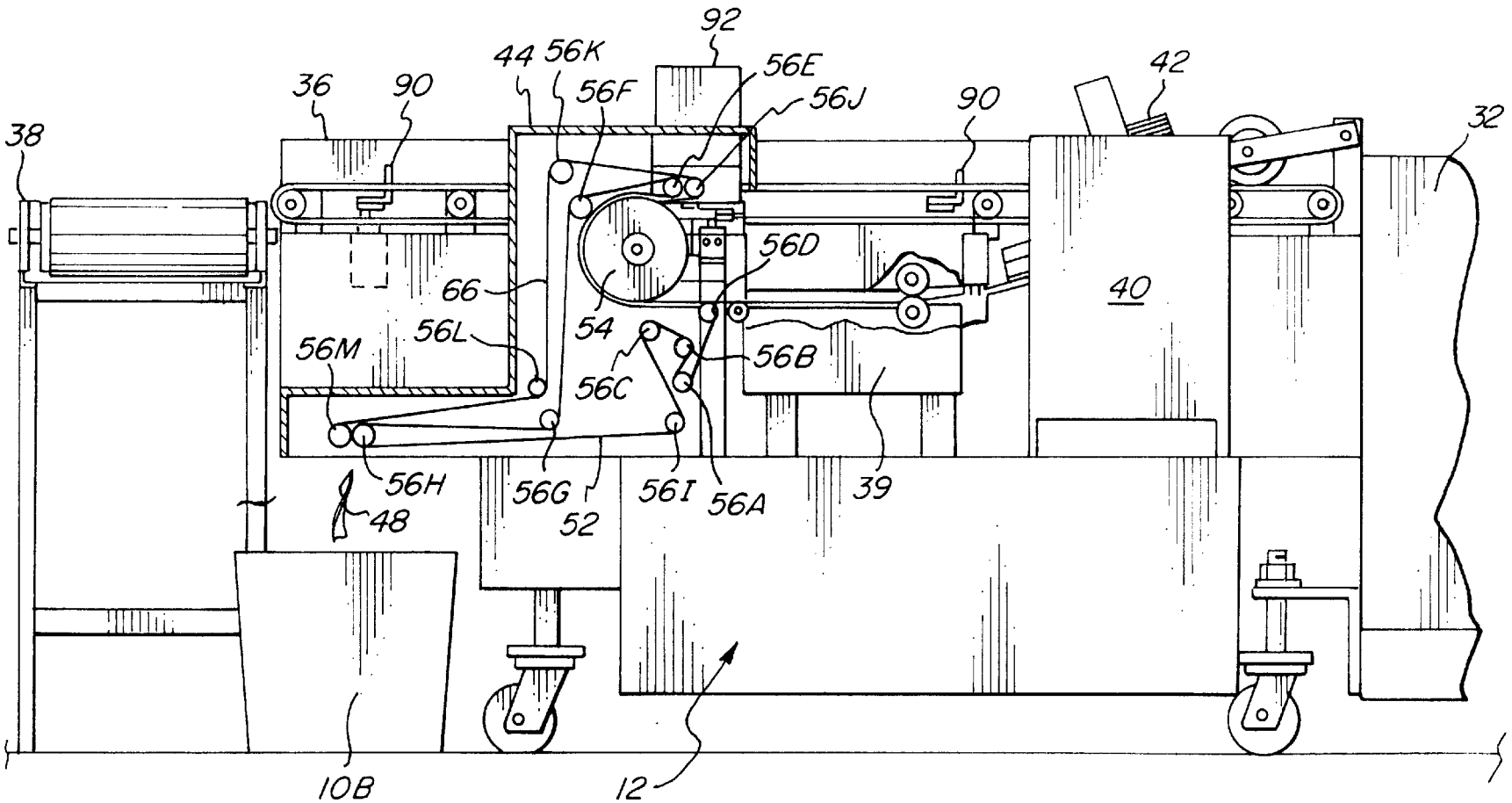
FIG. 2 is a side elevational view of a portion of the electronic finishing system showing the labelling apparatus of the present invention with parts of its housing broken away to illustrate internal structure.
Figure 4:
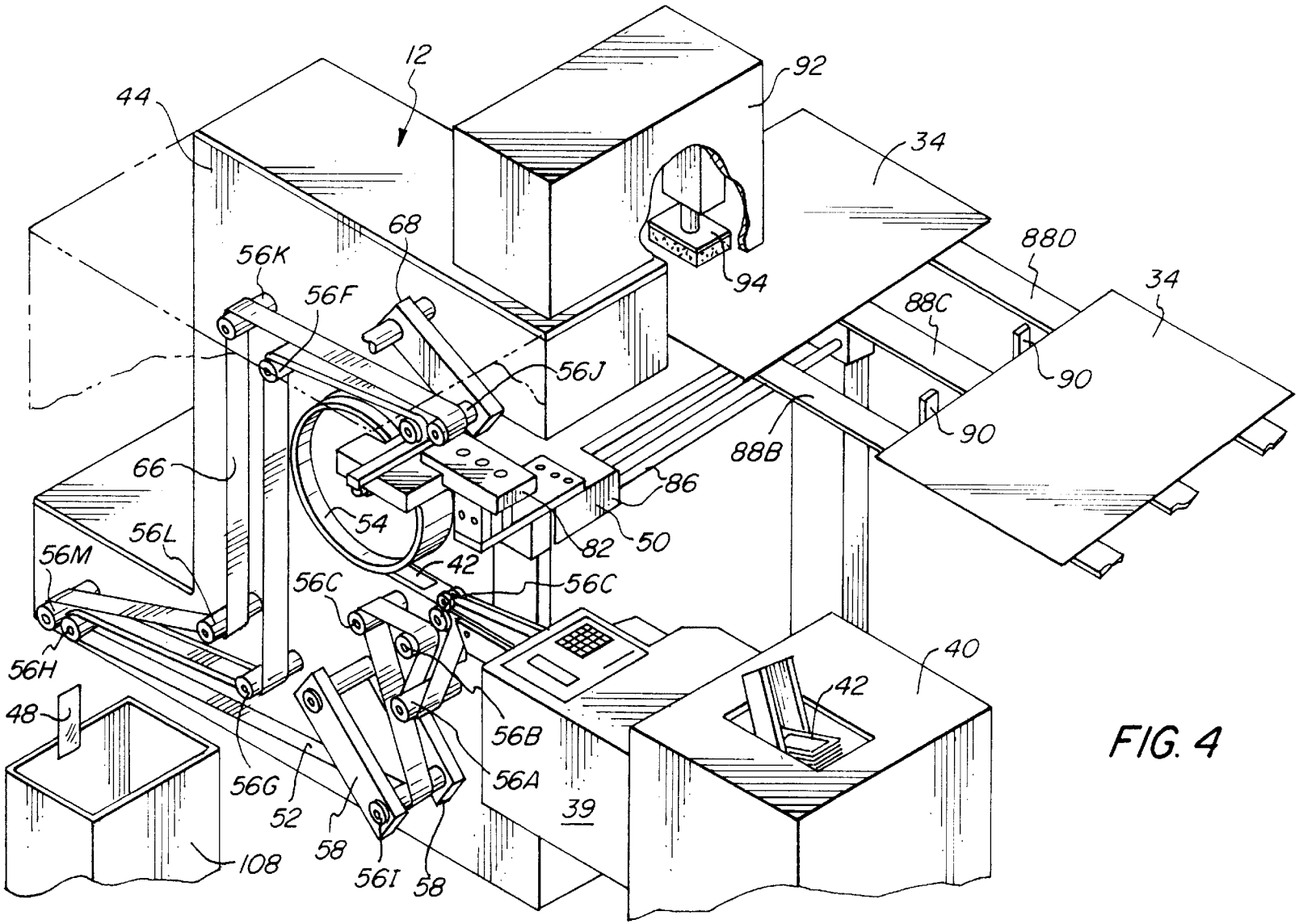
FIG. 4 is a perspective view of a portion of the labelling apparatus of the present invention with portions of its housing broken away to illustrate internal structure.
Figure 5:
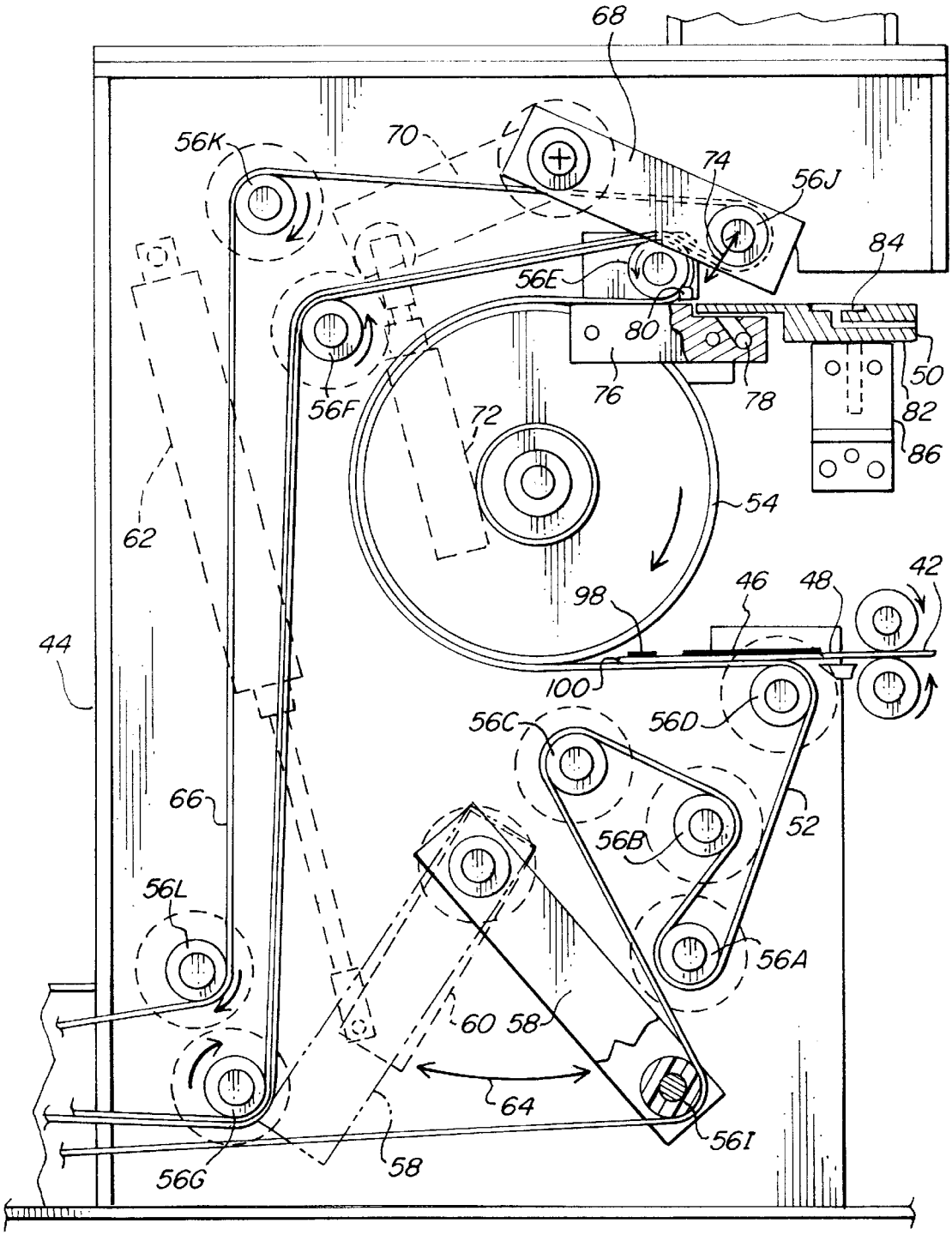
FIG. 5 is a fragmentary side elevational view of the label separating system of the labelling apparatus of the present invention with portions of the housing removed to illustrate internal structure and showing the belt release mechanism in its tensioned and released positions.
Figure 9A:
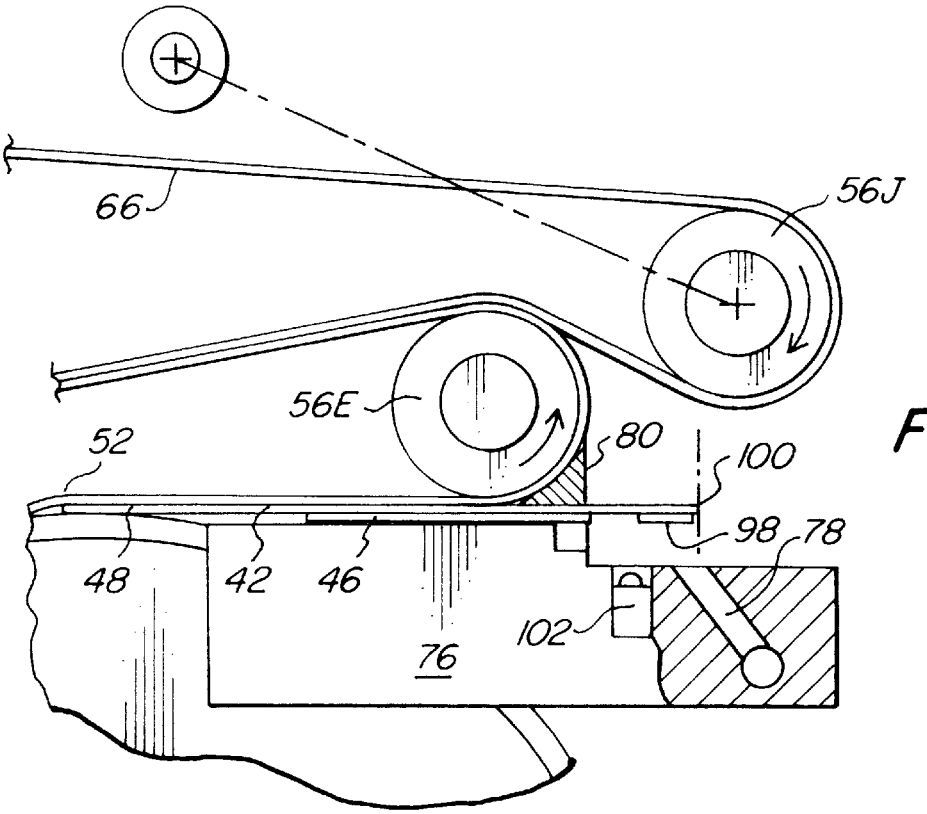
Figure 9B:
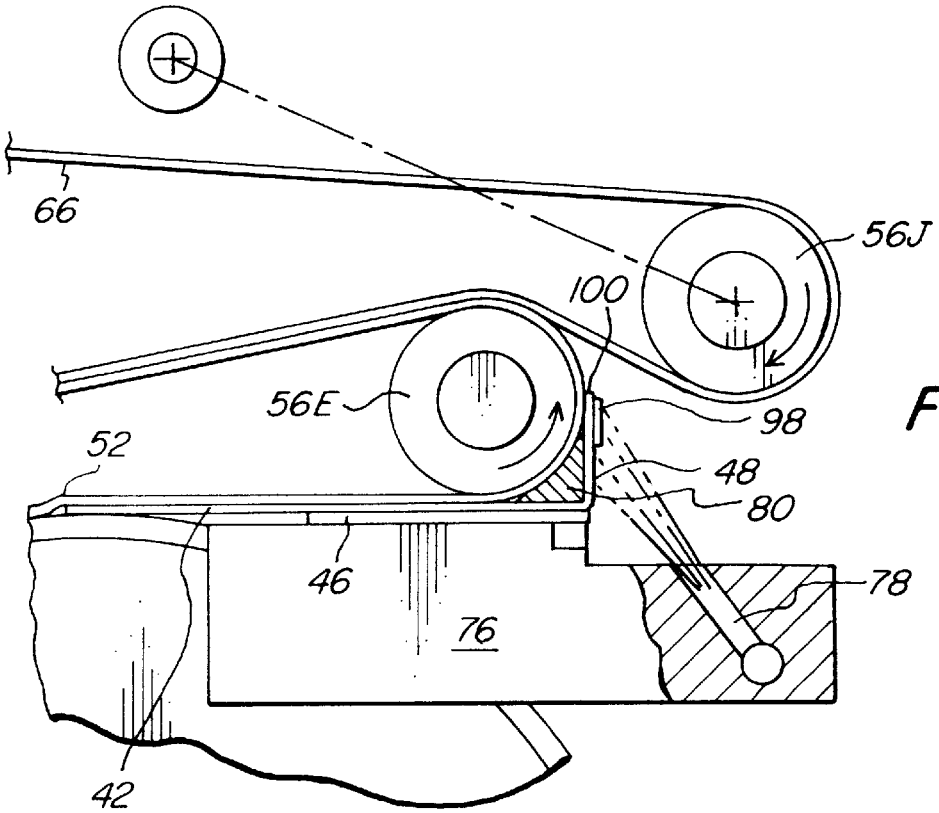

The operation of the label separating system 44 of the labelling module 12 can be clearly understood when considering FIGS. 9A–9E along with FIGS. 2–5. It should first be understood that appropriate well-known reflective fiber optic sensors (not shown) are located along the indexing conveyor 36 to detect the presence (or absence) of the packages 34 thereon and along the travel path of the label-tab-release sheet combination 42 to detect the presence (or absence) of the label-tab-release sheet combination 42 and the label 46 therein. In FIG. 3, the labelling module 12 has just applied a label 46 to the package 34 under the tamper device 92. As this is done, the computer processing unit (not shown), which has been monitoring the next package 34 to be labelled as it has proceeded through the electronic finishing system 10, activates the singulator feeder 40 to feed a single label-tab-release sheet combination 42 to the postage meter 39 which applies the proper postage to the label 46. The computer processing unit controls the amount of postage to be applied based on its calculation of the weight of the package 34 from the known weights of the various sheets, inserts and envelopes used to form the package 34. The label-tab-release sheet combination 42 is then delivered with the label 46 in an upward position by the indexing conveyor 36 to the first endless belt 52 of the label separating system 44 as shown in FIG. 5. The label-tab-release sheet combination 42 enters the nip formed between the first endless belt 52 and the roller drum 54 and travels upwardly toward the anvil 80. As seen in FIGS. 9A and 9B, as soon as the presence of the label-tab-release sheet combination 42 is detected by a sensor 102 opposite the anvil 80, the air blast device 78 is activated to move the leading edge 100 of the label-tab-release sheet combination 42 and the tab 98 thereon upwardly. The spacing between the tab 98 and the label 46 allows the release sheet 48 to bend around the anvil 80. Simultaneously, as shown in FIG. 9C, the pneumatic piston-cylinder device 72 (FIG.5) is activated to pivot the roller 56J downward toward the leading edge 100 of the label-tab-release sheet combination 42 to trap the same in the nip formed by the first and second endless belts 52, 66. The tab 98 serves a dual function of providing sufficient mass to be engaged by the air blast of the air blast device 78 and providing a good gripping surface to be engaged by the second conveyor belt 66 as it is pivoted downwardly to capture the label-tab-release sheet combination 42. In FIG. 9D, as the leading edge 100 of the label-tab-release sheet combination 42 continues its upward travel between the first and second endless belts 52, 66, the action of the anvil 80 on the release sheet 48 causes the label 46 to release from the release sheet 48 and travel in the direction of arrow 104 onto the shuttle 82. As seen in FIG. 9E, once the label 46 is fully released from the release sheet 48, a vacuum force indicated by arrow 106 created by the vacuum system 84 holds the label 46 in a proper position for transport. The release sheet 48 with the tab 98 thereon continues through the label separating system 44 and is deposited as scrap in a waste container 108 when it exits from between the rollers 56H and 56M as shown in FIGS. 2 and 4. After the label 46 is separated from the release sheet 48, the roller 56J returns to its upwardly pivoted position.

Figure 10A:
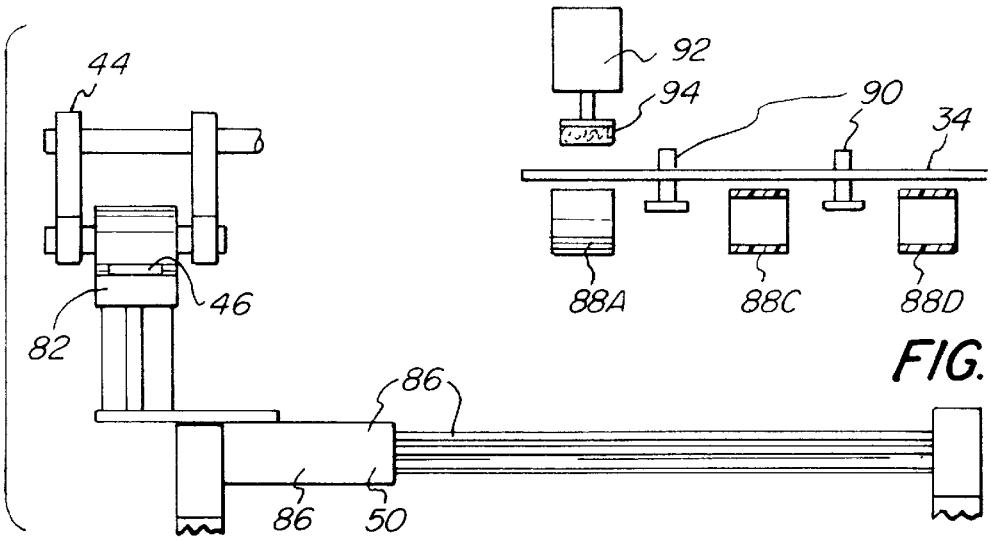
FIGS. 10A–10C are schematic diagrammatic end elevational views showing the sequence of operation of the label shuttle for conveying a separated label from the anvil portion of the label separating system to the package on which it is applied.
Figure 10B:
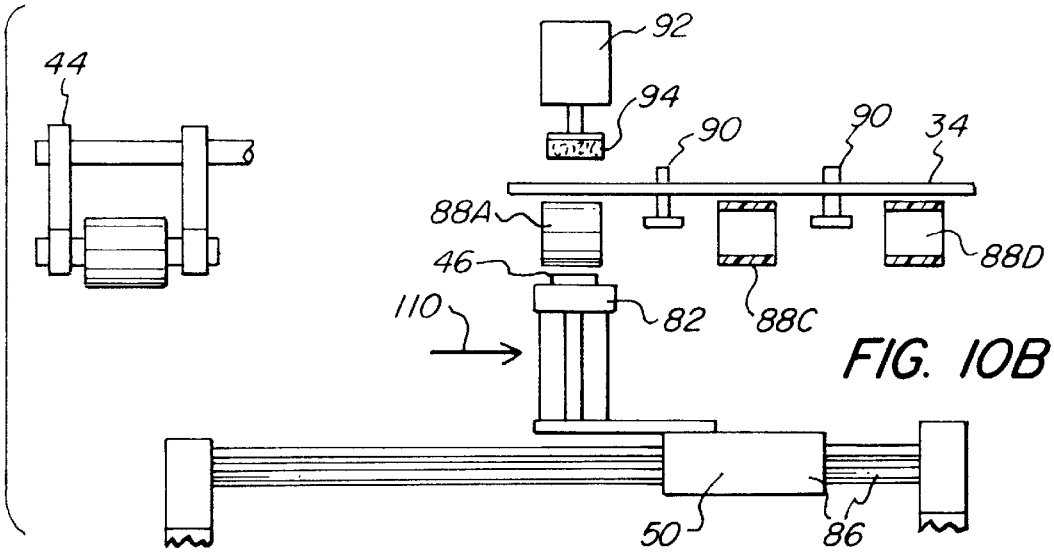
Figure 10C:
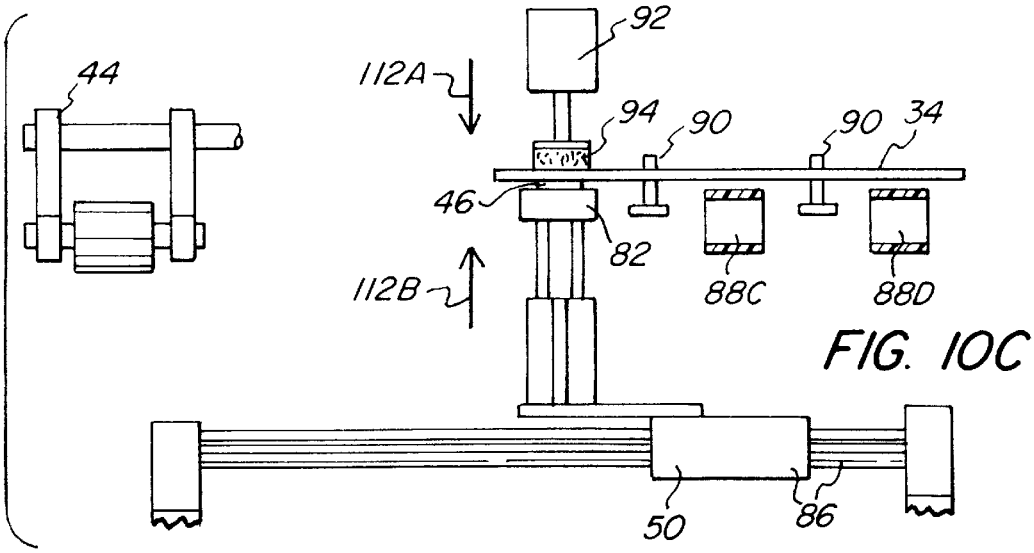

When considering FIGS. 10A–10C, the operation of the label shuttle device 50 can also be clearly understood. After a label 46 is positioned on the shuttle 82 by the label separating system 44 and a package 34 is positioned under the tamper 94 by the indexing conveyor 36 as seen in FIG. 10A, the shuttle 82 is moved in the direction of arrow 110 (FIG. 10B) from its position adjacent the label separating system 44 to a position underneath the tamper 94 and the package 34. This movement is controlled by means of the magnetically coupled rodless cylinder device 86. The tamper 94 and the shuttle 82 then move together as illustrated by arrows 112A, 112B (FIG. 10C) by means of pneumatic piston-cylinder devices (not shown) thereby sandwiching the package 34 therebetween. This action of the tamper 94 and the shuttle 82 causes the label 46 to be transferred from the shuttle 82 to the package 34 under the influence of the adhesive 101 (FIG. 8) on the label 46 as the vacuum system 84 on the shuttle 82 is shut off just prior to activation of the tamper 94. Concurrently, the computer processing unit (not shown) activates the singulator feeder 40 to feed another label-tab-release sheet combination 42 to the postage meter 39 which applies the proper postage to the label 46. The shuttle 82 is then returned to its home position adjacent the label separating system 44 to be ready to receive the next label 46 as the abutment fingers 90 drop from the path of the packages 34 on the indexing conveyor 36 and all the packages 34 are indexed forward whereby the next unmetered package 34 is positioned underneath the tamper 94 ready to receive its label 46. The previously described cycle is repeated with the top anticipated speed being 1200–1700 packages per hour.

Figure 12:
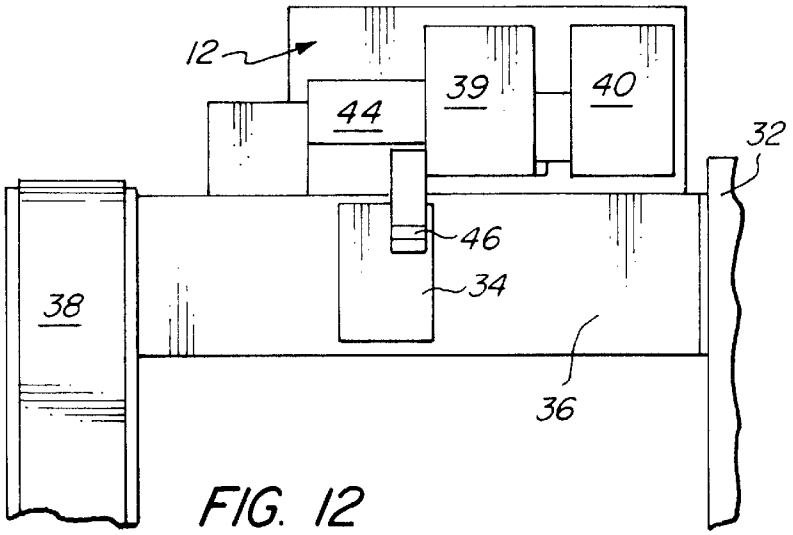
FIGS. 11–12 are schematic diagrammatic top plan views showing two possible locations of the labelling module so as to permit positioning the label at two different positions on the packages.
Figure 11:
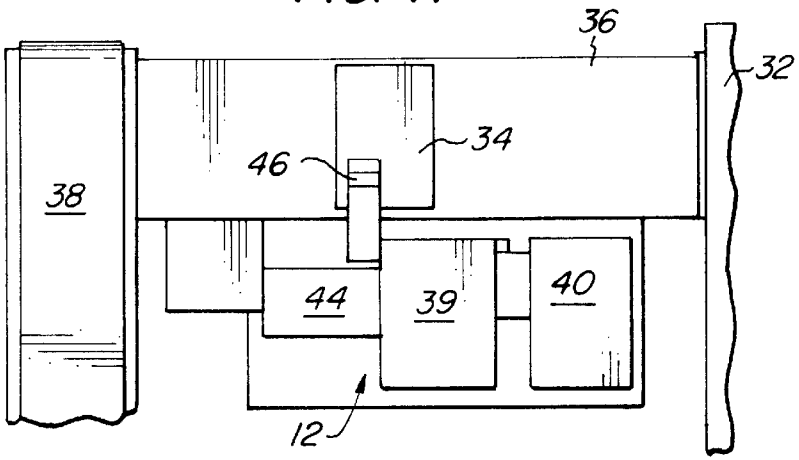

The embodiment of the label shuttle device 50 described above will place the labels 46 on the packages 34 with the length dimension of the labels 46 parallel to the width dimension of the packages 34 as shown in FIG. 11. Depending on the needs of the user, it is sometimes desirable to position the labelling module 12 on the other side of the indexing conveyor 36 as shown in FIG. 12 whereby the label shuttle device 50 will place the labels 46 on the packages 34 with the length dimension of the labels parallel to the width dimension of the packages but on the opposite side of the packages. If desired, the labelling module 12 can also be positioned closer to the enveloper 32 as shown in FIG. 12 to place the labels 46 in the opposite corner of the envelope than the FIG. 11 position.

Figure 13:
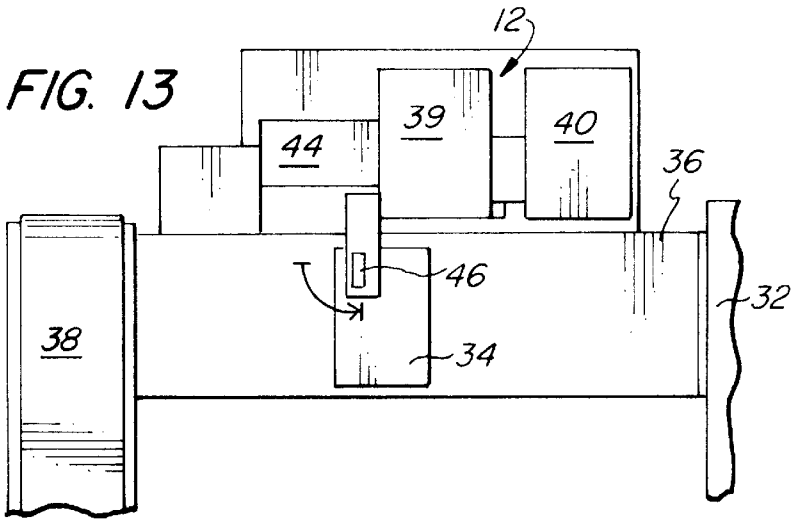
FIGS. 13–14 are schematic diagrammatic top plan views showing two possible locations of a labelling module having an alternative label shuttle device so as to permit positioning the label in a "landscape" orientation at two different positions on the packages.
Figure 14:
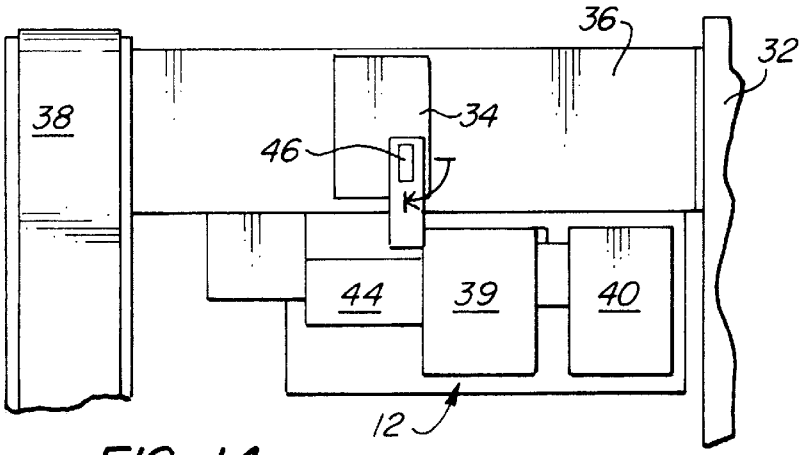

Those skilled in the art will realize that the user will sometimes need to place the labels 46 on the packages 34 with the length dimension of the labels 46 parallel to the length dimension of the packages 34 in a so-called "landscape" orientation as shown in FIGS. 13–14. To accomplish this, another embodiment (FIG. 15) of the label shuttle device generally indicated by numeral 200 has been devised.

Figure 16:
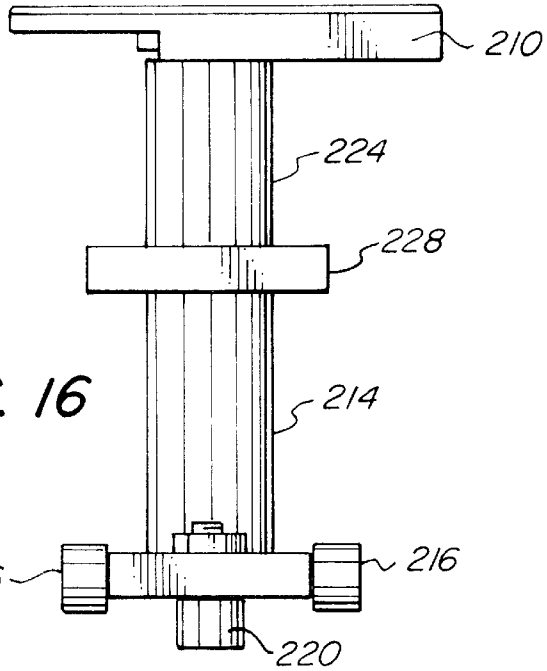
FIG. 16 is an end elevational view of the shuttle in FIG. 15.
Figure 17:
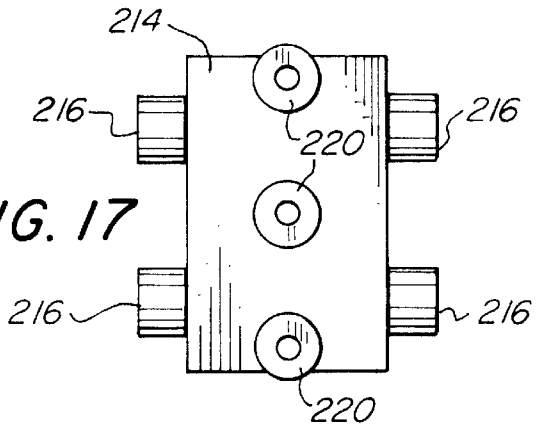
FIG. 17 is an bottom plan view of the shuttle in FIG. 15.
Figure 15:
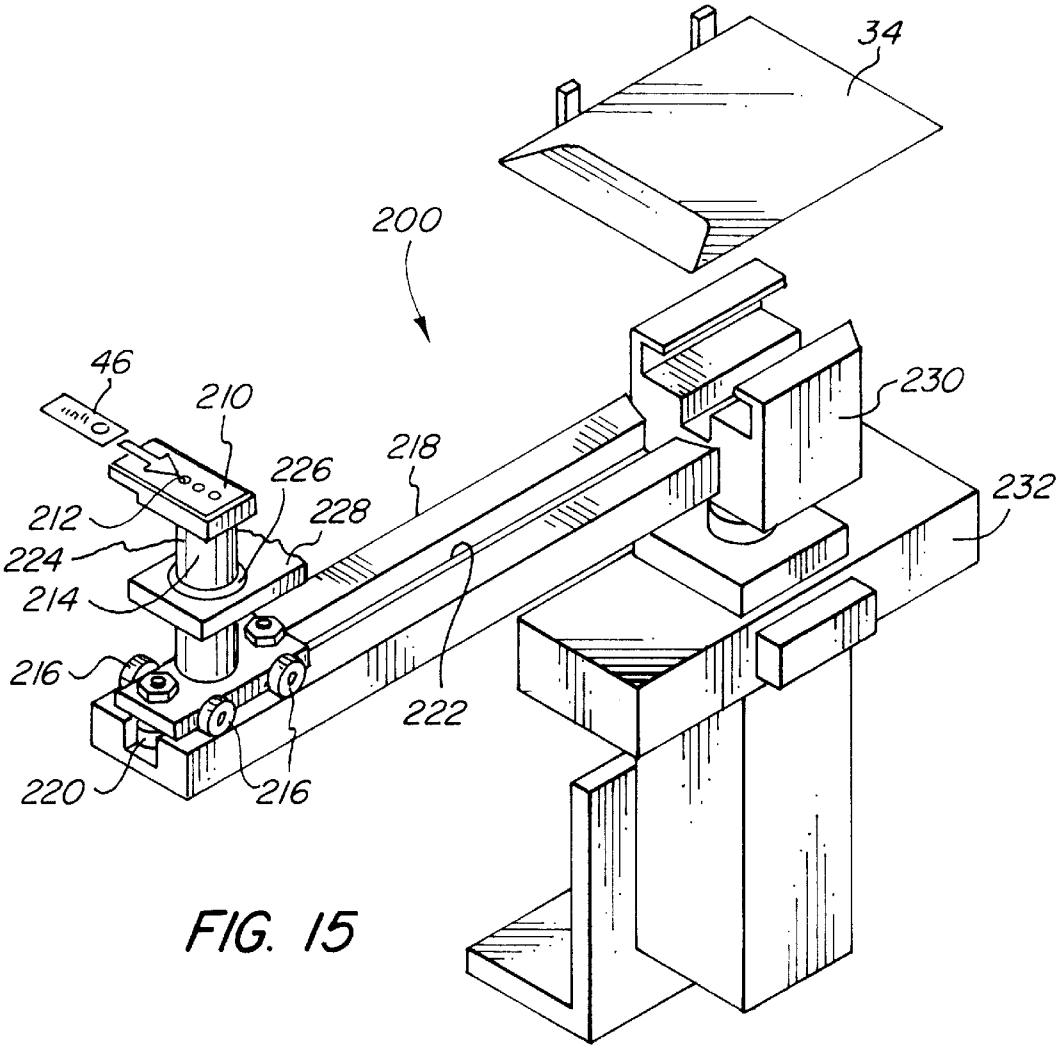
FIG. 15 is a perspective view of the alternative label shuttle device used in the labelling module of the present invention.

A shuttle 210 having a vacuum system 212 for holding the label 46 in place is mounted on a carriage 214 for movement to a position under the package 34 located on the indexing conveyor 36 (not shown in FIG. 15). The carriage 214 has four wheels 216 for riding on a track 218 and three rollers 220 (FIGS. 16–17) for guiding the carriage 214 along a groove 222 of the track 218. The carriage 214 also has a cylindrical upright member 224 which is captured in a bushing 226 of an arm 228 which reciprocates the carriage 214 along the track 218 by means of a magnetically coupled rodless cylinder device (not shown) similar to the device 86 described with respect to the label shuttle device 50. At the end of the track 218 is a turntable 230 mounted on a rotary cylinder device 232.

Figure 18A:
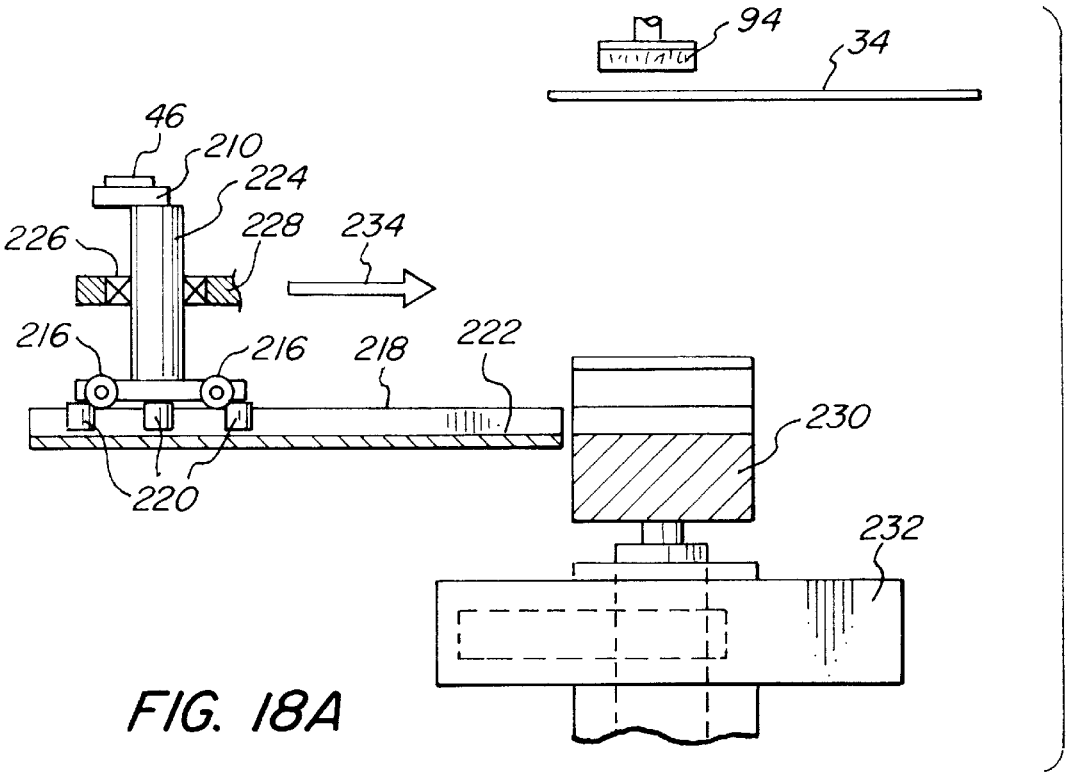
FIGS. 18A–18D are schematic diagrammatic end elevational views showing the sequence of operation of the alternative label shuttle system of FIG. 15.
Figure 18B:
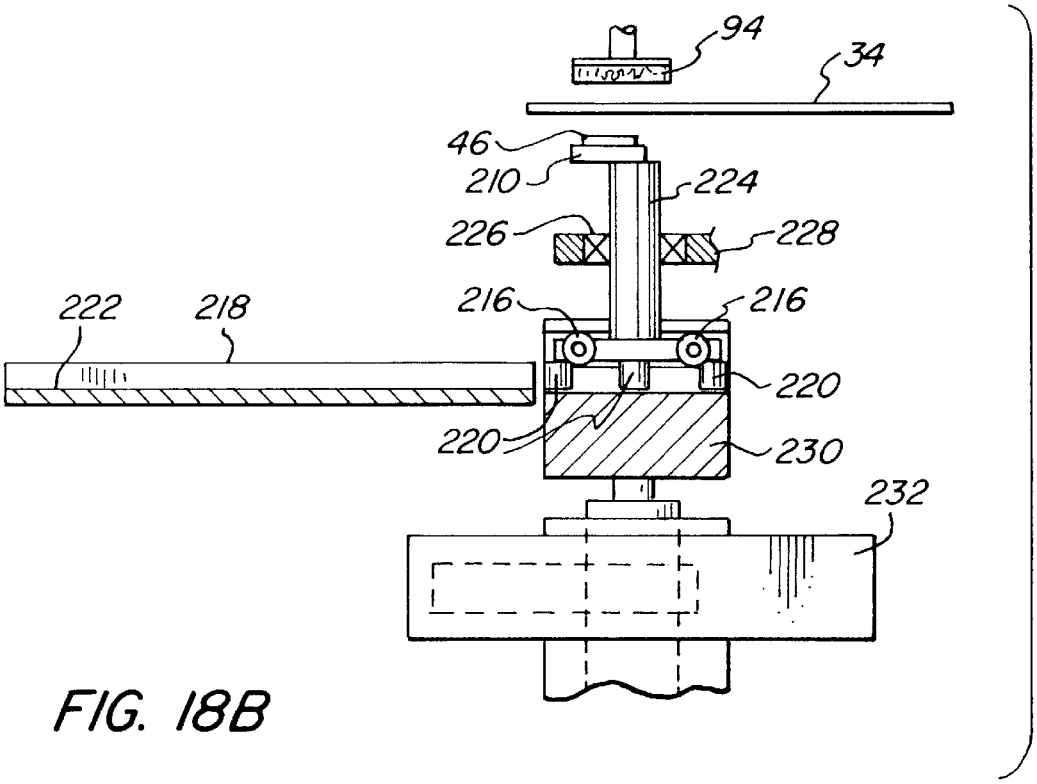
Figure 18C:
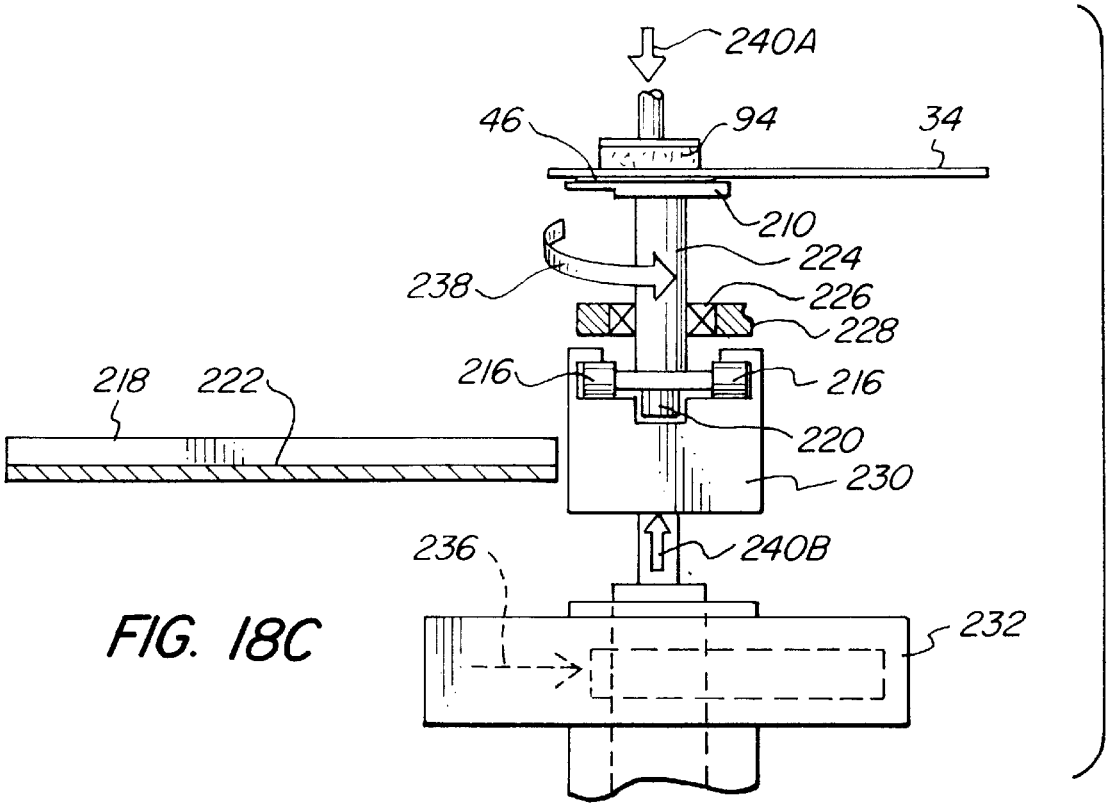
Figure 18D:
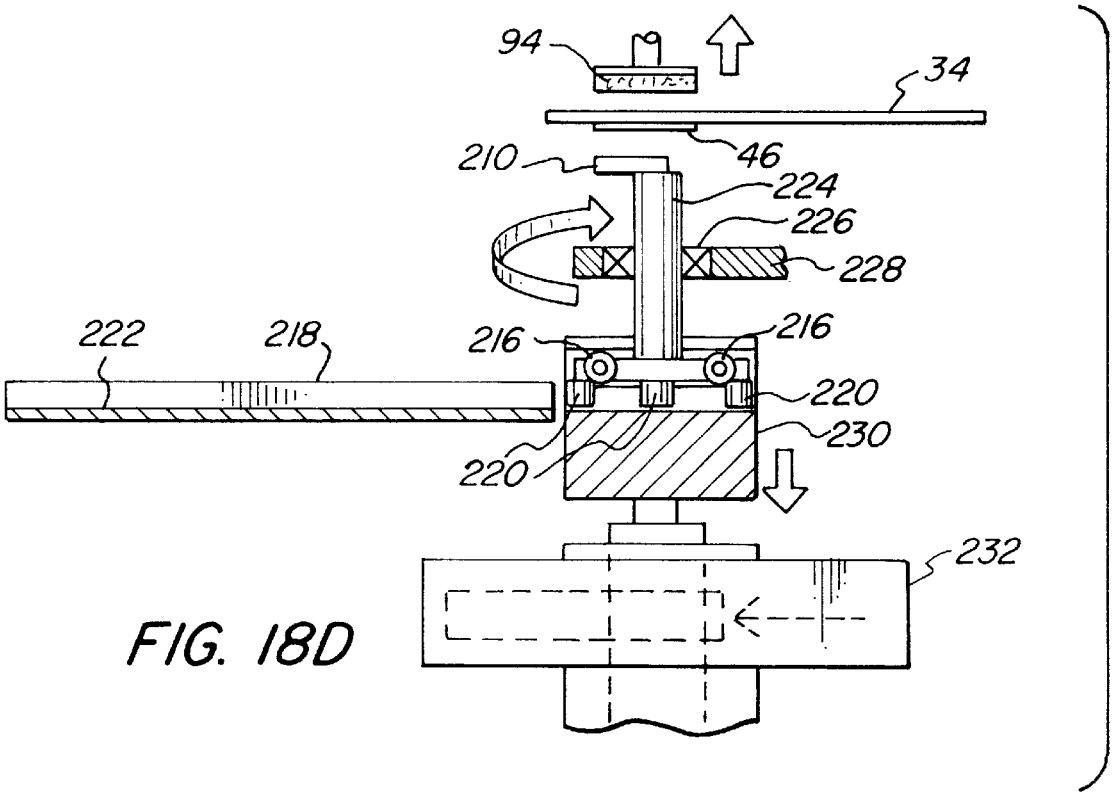

Referring now to FIGS. 18A–18D, the operation of the alternative label shuttle device 200 can be understood. After a label 46 is positioned on the shuttle 210 by the label separating system 44 and a package 34 is positioned under the tamper 94 by the indexing conveyor 36, the carriage 214 and the shuttle 210 are moved in the direction of arrow 234 (FIG. 18A) from its position adjacent the label separating system 44 to a position underneath the tamper 94 and the package 34 as seen in FIG. 18B with the carriage 214 engaged in the turntable 230. This movement is controlled by means of the magnetically coupled rodless cylinder device (not shown). The rotary cylinder device 232 is then activated as indicated by arrow 236 (FIG. 18C) to rotate the turntable 230, the carriage 214, the shuttle 210 and the label 46 though an angle of ninety degrees as indicated by arrow 238 (FIG. 18C). An instant later, the tamper 94 and the shuttle 210 are moved together as illustrated by arrows 240A, 240B (FIG. 18C) by means of pneumatic piston-cylinder devices (not shown) thereby sandwiching the package 34 therebetween. This action of the tamper 94 and the shuttle 210 causes the label 46 to be transferred from the shuttle 210 to the package 34 under the influence of the adhesive 101 (FIG. 8) on the label 46 as the vacuum system 212 on the shuttle 210 is deactivated. This procedure is then reversed as shown in FIG. 18D to separate the tamper 94 and shuttle 210 and return the shuttle 210, carriage 214 and turntable 230 though the ninety degree rotation. The shuttle 210 is then returned to its home position adjacent the label separating system 44 to be ready to receive the next label 46. Thus, the alternative label shuttle device 200 provides an effective means to apply the labels 46 in a "landscape" orientation on the packages 34.

Although not explained in detail, it will be appreciated by those skilled in the art that the labelling module 12 is event driven and appropriate sensors (e.g. well-known reflective fiber optic sensors) are located throughout the labelling module 12 to ensure that the various components thereof are in the proper position during each sequence of operation. The computer processing unit (not shown) controls the operation of the entire electronic finishing system 10 including the labelling module 12. This arrangement provides a fail safe system whereby damage to the machine is prevented and quality of the final packages is assured.

It should also be understood that, although not shown in the drawings for reasons of clarity of illustration, the various pneumatic piston-cylinder devices used in connection with the invention are provided with flexible couplings in a well-known manner to account for manufacturing tolerances and any misalignment thereof.

Thus, artisans skilled in the art will appreciate that the labelling module 12 of the present invention as described herein can be employed advantageously to receive postage metered labels 46 from the postage meter 39, strip the label 46 from its release sheet 48, and then apply the label 46 to its respective package 34 in an efficient and convenient manner. It will, therefore, be seen from the above that the invention described admirably achieves the objects of the invention. However, it will be appreciated that departures can be made by those skilled in the art without departing from the spirit and scope of the invention, which is limited only by the following claims.

Having thus described the invention, what is claimed is:

1. An apparatus for applying a label to a package, which comprises:

(a) a conveying device for delivering one sequentially delivered package at a time;

b) a label separating device for separating an adhesive backed label from a release sheet for each sequentially delivered package and delivering the adhesive backed label to a shuttle device adjacent said conveying device; and (c) a shuttle device for receiving the adhesive backed label from said label separating device, transporting the adhesive backed label to a position adjacent its respective sequentially delivered package and applying the adhesive backed label to its respective sequentially delivered package on said conveying device, wherein said label separating device includes two opposed endless belts for transporting each adhesive backed label on its release sheet to a position adjacent said shuttle device.

2. The label application apparatus in accordance with claim 1, wherein said label separating device includes means providing a corner around which the release sheet passes to separate the adhesive backed label from its release sheet and deliver the adhesive backed label to said shuttle device.

3. The label application apparatus in accordance with claim 2, wherein said label separating device includes an air blast device for causing the release sheet to pass around said corner.

4. The label application apparatus in accordance with claim 3, wherein said air blast device causes said release sheet to be engaged by said endless belts.

5. The label application apparatus in accordance with claim 4, wherein one of said endless belts is reciprocally moveable to grasp said release sheet as said air blast causes said release sheet to pass around said corner.

6. An apparatus for applying a label to a package, which comprises:

(a) a conveying device for delivering one sequentially delivered package at a time;

(b) a label separating device for separating an adhesive backed label from a release sheet for each sequentially delivered package and delivering the adhesive backed label to a shuttle device adjacent said conveying device; and (c) a shuttle device for receiving the adhesive backed label from said label separating device, transporting the adhesive backed label to a position adjacent its respective sequentially delivered package and applying the adhesive backed label to its respective sequentially delivered package on said conveying device, wherein said label separating device includes means providing a corner around which the release sheet passes to separate the adhesive backed label from its release sheet and deliver the adhesive backed label to said shuttle device, said label separating means includes an air blast device for causing the release sheet to pass around said corner, said air blast device causes said release sheet to be engaged by means to convey said release sheet.

7. The label application apparatus in accordance with claim 6, wherein said means to convey said release sheet is a pair of endless belts at least one of which is reciprocally moveable to grasp said release sheet as said air blast causes said release sheet to pass around said corner.

8. An apparatus for applying a label to a package, which comprises:

(a) a conveying device for delivering one sequentially delivered package at a time;

(b) a label separating device for separating an adhesive backed label from a release sheet for each sequentially delivered package and delivering the adhesive backed label to a shuttle device adjacent said conveying device; and (c) a shuttle device for receiving the adhesive backed label from said label separating device, transporting the adhesive backed label to a position adjacent its respective sequentially delivered package and applying the adhesive backed label to its respective sequentially delivered package on said conveying device, said shuttle device comprises a shuttle cooperating with said label separating device for receiving said adhesive backed label therefrom, transporting the adhesive backed label to a position adjacent its respective sequentially delivered package and applying the adhesive backed label to its respective sequentially delivered package, said shuttle is operationally connected to means for rotating said shuttle while the adhesive backed label is located thereon, said shuttle includes a carriage which is reciprocated on a track by said means to reciprocate said shuttle between a position adjacent said label separating device to a position adjacent said conveying device, said means for rotating said shuttle includes a turntable for positioning said carriage relative to said conveying device just prior to applying the adhesive backed label to its respective sequentially delivered package.

9. A label separating device for separating an adhesive backed label from a release sheet, which comprises:

(a) means providing a corner around which the release sheet passes to separate the adhesive backed label from its release sheet; and (b) an air blast device creating an air blast for causing the release sheet to pass around said corner and to be engaged by means to convey the release sheet.

10. The label separating device in accordance with claim 9, wherein said means to convey the release sheet is a pair of endless belts at least one of which is reciprocally moveable to grasp the release sheet as said air blast causes the release sheet to pass around said corner.

11. A label separating device in accordance with claim 9, wherein the release sheet has leading and trailing edges, the adhesive backed label is releasably received on the release sheet spaced from the leading and trailing edges thereof, thereby creating a leading portion of the release sheet between the leading edge and the adhesive backed label and a trailing portion of the release sheet between the trailing edge and the adhesive backed label, and further including a tab member received on the release sheet in the leading portion of the release sheet and spaced from the adhesive backed label whereby the tab member as well as the release sheet are engaged by said air blast for causing the release sheet to pass around said corner and to be engaged by means to convey the release sheet so as to separate the adhesive backed label from the release sheet.

12. A method for separating an adhesive backed label from a release sheet, which comprises the steps of:

(a) providing a corner around which the release sheet passes to separate the adhesive backed label from the release sheet;

(b) providing an air blast device creating an air blast causing the release sheet to pass around said corner and to be engaged by means to convey the release sheet; and (c) passing the release sheet around the corner to separate the adhesive backed label from the release sheet.

13. A method in accordance with claim 12, wherein said means to convey the release sheet is a pair of endless belts at least one of which is reciprocally moveable to grasp the release sheet as said air blast causes the release sheet to pass around said corner.

14. A method in accordance with claim 12, wherein the release sheet has leading and trailing edges, the adhesive backed label is releasably received on the release sheet spaced from the leading and trailing edges thereof, thereby creating a leading portion of the release sheet between the leading edge and the adhesive backed label and a trailing portion of the release sheet between the trailing edge and the adhesive backed label, and further including a tab member received on the release sheet in the leading portion of the release sheet and spaced from the adhesive backed label whereby the tab member as well as the release sheet are engaged by said air blast for causing the release sheet to pass around said corner and to be engaged by means to convey the release sheet so as to separate the adhesive backed label from the release sheet.

* * * * *